US010065823B2

(12) United States Patent
Cooke et al.

(10) Patent No.: US 10,065,823 B2
(45) Date of Patent: Sep. 4, 2018

(54) ROTARY STORAGE

(75) Inventors: Nicholas Cooke, St. Andrews (GB); David A. Inglis, Dundee (GB)

(73) Assignee: NCR Corporation, Atlanta, GA (US)

( * ) Notice: Subject to any disclaimer, the term of this patent is extended or adjusted under 35 U.S.C. 154(b) by 929 days.

(21) Appl. No.: 13/095,002

(22) Filed: Apr. 27, 2011

(65) Prior Publication Data

US 2012/0273516 A1 Nov. 1, 2012

(51) Int. Cl.
*B65H 29/00* (2006.01)

(52) U.S. Cl.
CPC ..... *B65H 29/006* (2013.01); *B65H 2220/09* (2013.01); *B65H 2403/72* (2013.01); *B65H 2403/731* (2013.01); *B65H 2701/1912* (2013.01)

(58) Field of Classification Search
CPC ..... B65H 29/006; B65H 2220/09; B65H 2701/1912; B65H 2403/72; B65H 2403/731
USPC ..... 242/528; 271/216, 3.01
See application file for complete search history.

(56) References Cited

U.S. PATENT DOCUMENTS 4,871,125 A * 10/1989 Haueter ..... 242/528
7,845,573 B2 * 12/2010 Peters et al. ..... 235/494
2003/0116400 A1 * 6/2003 Saltsov et al. ..... 194/207
2010/0133289 A1 * 6/2010 Michels ..... 221/71
2011/0017766 A1 * 1/2011 Michels et al. ..... 221/71
2012/0077631 A1 * 3/2012 Wang ..... 474/149

FOREIGN PATENT DOCUMENTS

WO WO 2010149047 A1 * 12/2010 ..... F16G 5/20

* cited by examiner

*Primary Examiner* — Minh D Truong
*Assistant Examiner* — Juan J Campos, Jr.
(74) *Attorney, Agent, or Firm* — Schwegman, Lundberg & Woessner

(57) ABSTRACT

A rotary storage device is described. The device comprises a rotatable drum around which media items may be stored, and a tape reel rotatably mounted on a tape reel shaft and partially wound with tape extending from the tape reel to the rotatable drum. The device further comprises a motor coupled to both the rotatable drum and the tape reel shaft. The motor is operable to rotate in a deposit direction and in a dispense direction. The device comprises a friction clutch coupled to both the tape reel shaft and the tape reel to provide some resistance to rotation of the tape reel relative to the tape reel shaft so that the tape reel cannot rotate freely about the tape reel shaft. The device also comprises a one-way clutch coupled to the tape reel shaft to allow the tape reel shaft to rotate in the dispense direction and to prevent the tape reel shaft from rotating in the deposit direction.

3 Claims, 2 Drawing Sheets

FIG. 1
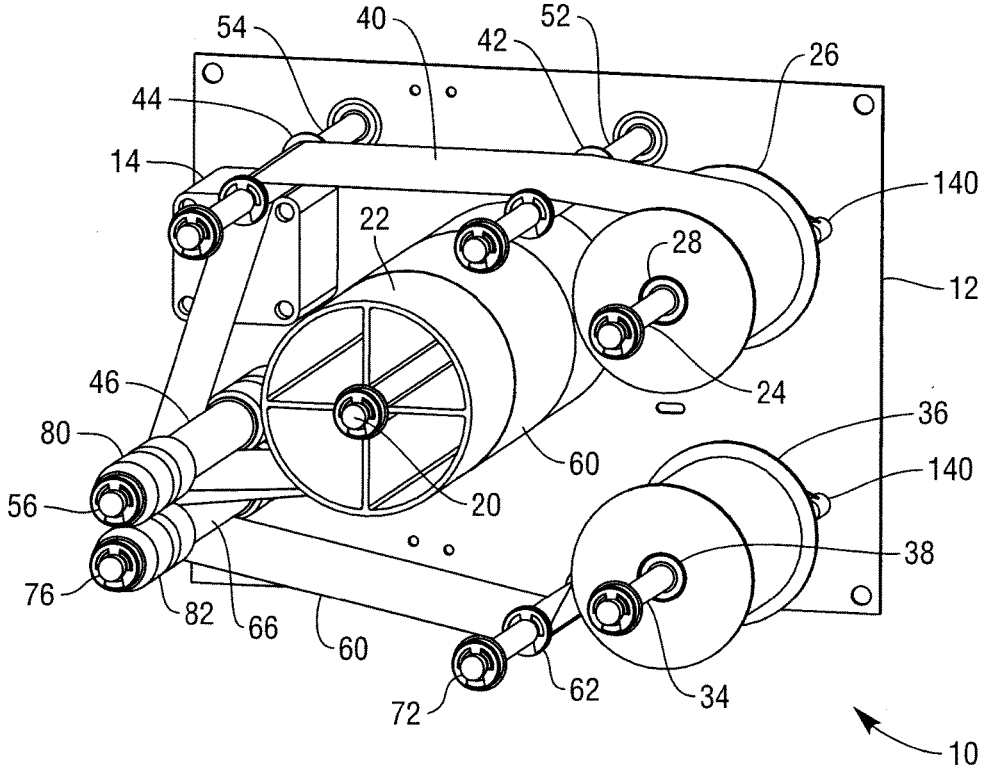
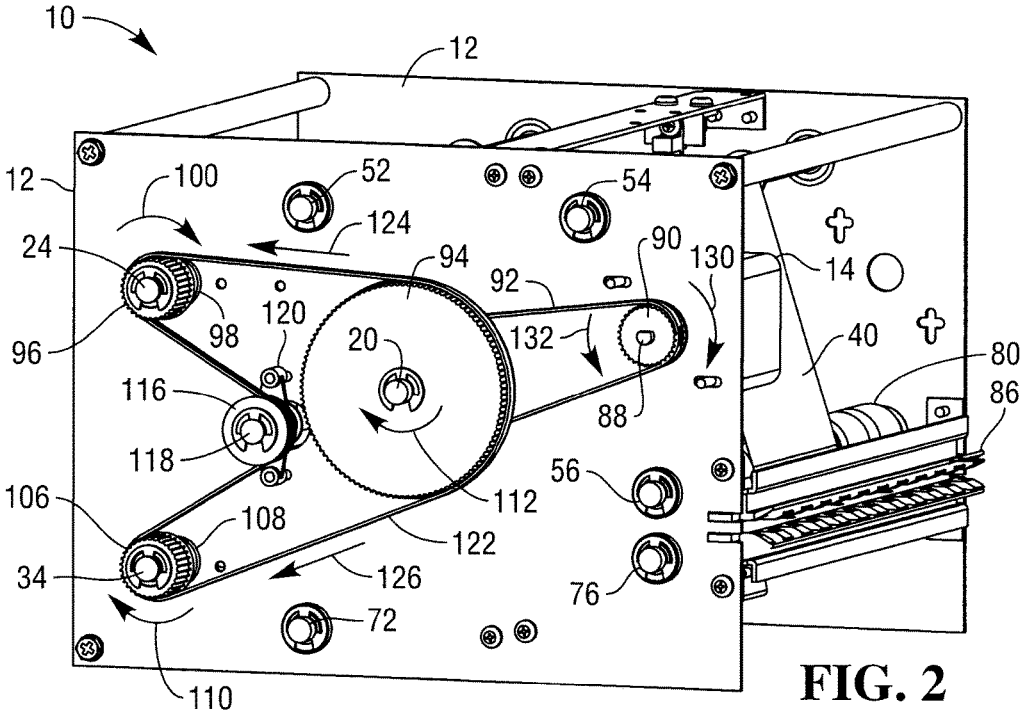
FIG. 2

ROTARY STORAGE

FIELD OF INVENTION

The present invention relates to rotary storage of media items.

BACKGROUND OF INVENTION

One implementation of rotary storage involves storing sheets of media items (such as banknotes) around a rotatable drum. This is sometimes referred to as a rotary storage device.

In a rotary storage device, the drum is rotated, and either one or two tapes are wound around the drum. Media items are stored individually, either between successive windings of the tape (where one tape is used), or between two tapes (where two tapes are used) as those tapes are wound around the drum.

One advantage of such rotary storage devices is that the stored media items can be removed by reversing the direction of the tape or tapes. Such rotary storage devices provide a "first in last out" store for media items and can guarantee the order in which media items will be transported.

To ensure that media items are stored reliably, it is imperative that the tape is (or tapes are) always held in tension to ensure that there is no slack in the tape (or tapes). Any slack in the tape(s) could cause the tape to loop or become tangled. At best this would reduce the storage capacity of media items (because of the extra space taken up by the loop or tangle as it is wound around the drum). In some cases, this may cause the rotary storage device to jam (or the tape(s) to become tangled), thereby putting the device out of service until a service engineer repairs the device by unwinding (or cutting) the tape(s), removing media items stored on the tape(s), and then replacing the tape or tapes.

One way of maintaining tension on the tape(s) is to provide one motor for the storage drum and a separate motor for each tape reel used. However, this increases the cost of the rotary storage device.

It would be desirable to provide a rotary storage device that only uses one motor to drive both the drum and the tape reel(s), while maintaining the tape(s) in tension.

SUMMARY OF INVENTION

Accordingly, the invention generally provides a rotary storage device comprising a motor driving both a tape reel shaft and a rotatable drum, where the device includes a one-way clutch on a tape reel shaft to prevent the shaft from rotating in a direction that allows tape to be removed from the tape reel.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a rotary storage device comprising:

a rotatable drum around which media items may be stored;

a tape reel rotatably mounted on a tape reel shaft and partially wound with tape extending from the tape reel to the rotatable drum;

a motor coupled to both the rotatable drum and the tape reel shaft, and operable to rotate in a deposit direction and in a dispense direction opposite the deposit direction;

a friction clutch coupled to the tape reel shaft and the tape reel to provide some resistance to rotation of the tape reel relative to the tape reel shaft so that the tape reel cannot rotate freely about the tape reel shaft; and a one-way clutch coupled to the tape reel shaft to allow the tape reel shaft to rotate in the dispense direction and to prevent the tape reel shaft from rotating in the deposit direction.

The rotary storage device may further comprise a housing having a pair of opposing sidewalls. Various shafts (including the tape reel shaft) may extend between the pair of opposing sidewalls and be mounted thereon. Additional shafts may include a rotatable drum shaft (on which the rotatable drum may be mounted) and guide shafts over which the tape may pass.

The one-way clutch may be mounted on one of the sidewalls.

The one-way clutch may be mounted on an inner surface of one of the sidewalls.

As used herein, "deposit" and "dispense" directions describe functional or relative directions not absolute directions. In particular, a "deposit" direction refers to the direction a shaft must rotate to allow media items to be loaded into the drum. Conversely, a "dispense" direction refers to the direction a shaft must rotate to allow media items to be unloaded from the drum. Depending on the configuration of the drum (for example, whether the tape is wound onto the drum clockwise or counter-clockwise) and the configuration of the shafts, if two shafts are rotated in the deposit direction; one shaft may rotate clockwise while the other shaft rotates counter-clockwise.

By virtue of this aspect a media storage device is provided that only requires one motor to drive both the tape reel shaft and the rotatable drum, and tension is maintained on the tape because the tape reel shaft cannot rotate in the deposit direction.

The rotary storage device may further comprise a second tape reel rotatably mounted on a second tape reel shaft and partially wound with tape extending from the second tape reel to the rotatable drum.

The rotary storage device may further comprise a second friction clutch coupled to the second tape reel shaft and the second tape reel to resist rotation of the second tape reel relative to the second tape reel shaft; and a second one-way clutch coupled to the second tape reel shaft to prevent the second tape reel shaft from rotating in the deposit direction and to allow the second tape reel shaft to rotate in the dispense direction.

The rotary storage device may further comprise a belt coupled to both the rotatable drum and each tape reel shaft. Each tape reel shaft may include a belt pulley around which the belt is coupled. Each belt pulley may include a one-way clutch so that each belt pulley only rotates its associated tape reel shaft in the dispense direction. This ensures that each tape reel is only rotated in the deposit direction by its tape being pulled off the tape reel by rotation of the drum.

The rotatable drum shaft may include a drum pulley mounted thereon and around which the belt is coupled.

The drum pulley may be larger than the (or each) belt pulley. The ratio of the circumference of the drum pulley to the circumference of the (or each) belt pulley may be greater than two to one; greater than four to one; or greater than five to one. By having a drum pulley that is larger than the belt pulley(s), the belt pulley(s) rotate at a faster rate than the drum pulley. This helps ensure that the tape reel(s) rotates relative to the tape reel shaft (that is, the tape reel slips around the shaft) when the motor is rotated in the deposit direction.

The friction clutch coupled to the tape reel shaft is preferably adjustable so that the level of resistance to motion can be set. This can be used to ensure that the amount of force applied by the tape when moving in the deposit direction is sufficient to allow the tape reel to slip relative to the tape reel shaft; but the amount of force applied by the tape reel shaft when rotating in the dispense direction is insufficient to allow the tape reel to slip relative to the tape reel shaft.

The value of the circumferential ratio of the drum pulley to the belt pulley(s) and the level of resistance of the friction clutch can be selected to ensure that the amount of force applied to the tape reel in the deposit direction exceeds the resistive force of the friction clutch, which exceeds the amount of force applied to the tape reel in the dispense direction.

Any convenient one-way clutch may be used, such as those available from Schaeffler (UK) Ltd, Forge Lane, Minworth, Sutton Coldfield B76 1AP, United Kingdom, see http://www.schaeffler.co.uk/content.schaeffler.co.uk/en/index.jsp.

Similarly, any convenient friction clutch may be used, such as those available from A & A Manufacturing Co. Inc., of 457 State Street, North Haven, Conn. 06473 USA, see http://www.polyclutch.com/.

The tape may comprise a polyester film. Alternatively, the tape may comprise a different type of polymer, or any other convenient natural or synthetic material.

The tape may comprise a length of between approximately sixty meters and one hundred and twenty meters; a width of between sixty millimeters and one hundred millimeters; and a thickness of between 0.02 and 0.06 millimeters.

Media items may be spaced along the tape at a pitch of approximately one hundred millimeters.

The rotary storage device may further comprise (or be connected to) an electronic control circuit for controlling the operation of the motor.

The rotary storage device may further comprise an optical sensor.

The tape may include a detection portion at either or both of its opposing short ends. The detection portion may comprise a transmission characteristic that differs from the transmission characteristic of the remaining portion (the normal portion) of the tape. For example, most of the tape may be optically transparent; whereas, the detection portion may be opaque or reflective. This would enable an optical sensor to detect whether the normal portion is present or whether the detection portion is present. If the detection portion is present, then the optical sensor indicates to the electronic control circuit that the tape is near to one of its ends.

The detection portion may include a mirror portion on each (or one) of its two opposing ends. The mirror portion may be formed by depositing silver, aluminium, silica, or any other reflective material thereon. The mirror portion may be detected by the optical sensor to indicate that the tape is nearing an end.

Where two tape reels are used, one tape may include a detection portion at an end coupled to one of the tape reels; whereas, the other tape may include a detection portion at an end coupled to the rotatable drum. Two optical sensors may be used, one aligned with each tape, so that each sensor can only read the optical characteristic of its associated tape (not the optical characteristic of the other tape). This would allow the rotary storage device to ascertain whether the tapes are nearly completely wound around the rotatable drum or nearly completely unwound from the storage drum without having to move either of the tapes and without having to reference a previous reading.

According to a second aspect there is provided a self-service terminal incorporating the media storage device of the first aspect.

The self-service terminal (SST) may be an automated teller machine (ATM), an information kiosk, a financial services centre, a bill payment kiosk, a lottery kiosk, a postal services machine, a check-in and/or check-out terminal such as those used in the retail, hotel, car rental, gaming, health-care, and airline industries, and the like.

According to a third aspect there is provided a method of storing media items between layers of tape wound on a rotatable drum, the method comprising:

rotating the drum in a deposit direction to unwind tape from a tape reel and to wind tape onto the drum;

providing a friction brake imparting a resistive force to motion of the tape reel relative to the tape reel shaft, where the resistive force is less than an amount of force applied to the tape reel in the deposit direction but greater than an amount of force applied to the tape reel in a dispense direction, which is opposite to the deposit direction; and using a one-way clutch coupled to a tape reel shaft to prevent the tape reel shaft from rotating in the deposit direction as the tape reel rotates.

The friction brake may be implemented using a friction clutch.

The layers of tape may be successive layers of one tape, or adjacent layers of two tapes.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIG. 1 is a diagram of a media storage device, with one sidewall removed, according to one embodiment of the present invention;

FIG. 2 is a diagram illustrating parts (a rotary drum pulley and tape reel pulleys) of the media storage device of FIG. 1 in more detail;

Figure 3:
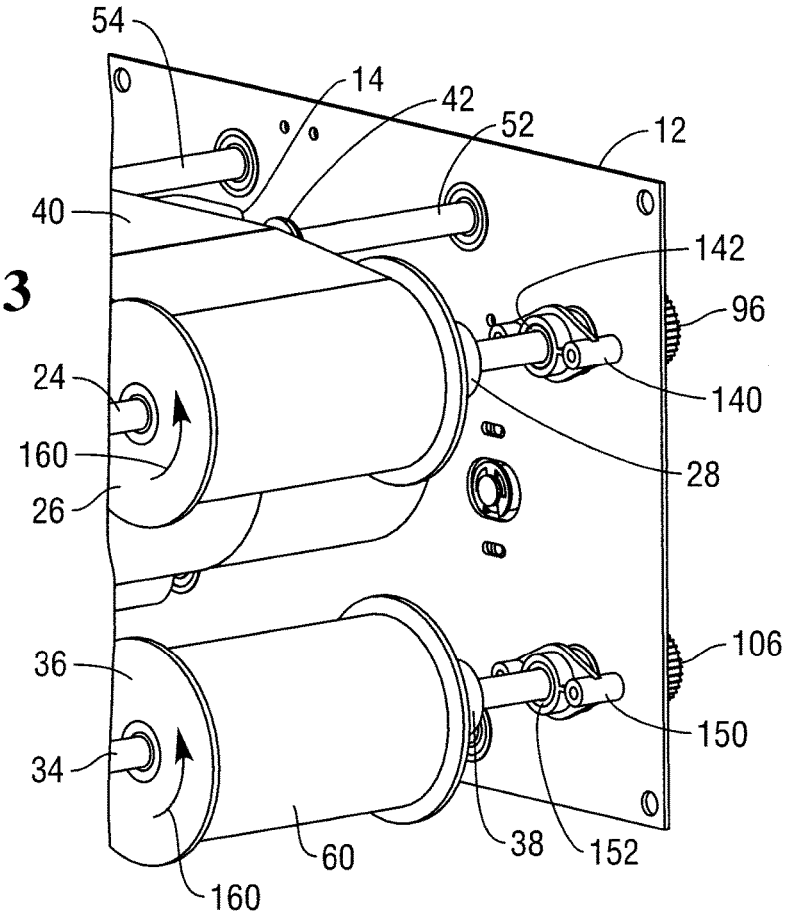
FIG. 3 is a diagram illustrating parts (tape reels) of the media storage device of FIG. 1 in more detail.

It should be appreciated the drawings provided are based on computer renderings from which actual physical embodiments can be produced. As such, some of these drawings contain details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

DETAILED DESCRIPTION

Reference is first made to FIG. 1, which is a diagram of a rotary storage device 10 according to one embodiment of the present invention. The rotary storage device 10 includes a pair of sidewalls 12, one of which has been removed from FIG. 1 for clarity.

A motor 14 is mounted on an inner surface of one of the sidewalls 12, as shown in FIG. 1. Various shafts extend between the pair of sidewalls 12, as will now be described.

A drum shaft 20 is located generally centrally on the sidewalls 12 and carries a rotatable drum 22 around which media items (such as banknotes) may be stored. The rotatable drum 22 is fixed to the drum shaft 20 and rotates therewith.

An upper (or first) tape reel shaft 24 extends between the pair of sidewalls 12 and carries an upper (or first) tape reel 26 mounted thereon for rotational movement thereabout. A first friction clutch 28 (barely visible in FIG. 1) is mounted between the upper tape reel shaft 24 and the upper tape reel 26 to provide some resistance to independent movement of the upper tape reel 26 relative to the upper tape reel shaft 24.

A lower (or second) tape reel shaft 34 extends between the pair of sidewalls 12 and carries a lower (or second) tape reel 36 mounted thereon for rotational movement thereabout. A second friction clutch 38 (also barely visible in FIG. 1) is mounted between the lower tape reel shaft 34 and the lower tape reel 36 to provide some resistance to independent movement of the lower tape reel 36 relative to the lower tape reel shaft 34.

In this embodiment, the first and second friction clutches 28,38 are identical, and each friction clutch 28,38 is adjustable. This means that the amount of resistive force (that is, the grip applied by the friction clutches to couple each tape reel 26,36 to its respective tape reel shaft 24,34) can be selected from a range of different resistive forces. One suitable friction clutch (also referred to as a slip clutch) is part number PAO 16, which is available from A & A Manufacturing Co., Inc., 457 State Street, North Haven, Conn. 06473, USA. If a force greater than the resistive force is applied to the tape reel 26,36 then the tape reel 26,36 will rotate relative to its respective tape reel shaft 24,34; whereas, if a force less than the resistive force is applied to the tape reel 26,36 then the tape reel 26,36 and its associated tape reel shaft 24,34 will rotate together as a single entity.

An upper (or first) tape 40 is partially wound around the upper tape reel 26 and extends to and is partially wound around, the rotatable drum 22. The upper tape 40 passes over a first upper idler reel 42, a second upper idler reel 44, and an upper pinch idler reel 46. Each of these three idler reels 42,44,46 is mounted on a respective fixed shaft 52,54,56.

A lower (or second) tape 60 is partially wound around the lower tape reel 36 and extends to and is partially wound around, the rotatable drum 22. The lower tape 60 passes over a lower idler reel 62 and a lower pinch idler reel 66. Each of these two idler reels 62,66 is mounted on a respective fixed shaft 72,76.

In this embodiment, the upper and lower tapes 40,60 comprise lengths of polyester film. In this embodiment, the tapes 40,60 comprise a length of approximately one hundred meters, a width of approximately eighty millimeters, and a thickness of approximately 0.04 millimeters. The tapes 40,60 include mirrored portions (not shown) at opposite ends of each of the tapes 40,60. These mirrored end portions comprise one meter long portions that are highly reflective. An optical sensor (not shown) is provided near the lower pinch idler reel 66 to detect when one of the mirrored end portions passes by. This can be used to alert an electronic control circuit (not shown) that the tape 40 or 60 is reaching one of its ends, thereby indicating that the rotary storage device is nearly empty or nearly full.

In some embodiments, one end portion may comprise highly reflective material; whereas, the opposite end may comprise partially reflective material, and the optical sensor may be capable of distinguishing between the two different reflectivities so that the electronic control circuit can ascertain which end of the tape 40,60 is being detected. In other embodiments, the direction of transport of the tape 40,60 may be used to ascertain which end of the tape 40,60 is being detected.

The upper pinch shaft 56 includes a pair of upper deformable rollers 80 mounted thereon. The lower pinch shaft 76 also includes a pair of lower deformable rollers 82 mounted thereon. The upper and lower rollers 80,82 are mutually aligned and mounted in close proximity to each other so that they define a gap that is thinner than banknotes which are fed therethrough. This ensures that the upper and lower rollers 80,82 are deformed by each banknote passing therebetween so that the upper and lower rollers 80,82 maintain contact with each banknote as it is transported.

Reference will now also be made to FIG. 2, which is a diagram illustrating parts on an outer surface of one of the sidewalls 12 of the rotary storage device 10. As shown in FIG. 2, the rotary storage device 10 includes a media slot 86 through which banknotes (or other media items) can be transported to enter or exit the rotary storage device 10.

The motor 14 includes a motor shaft 88 on which is mounted a toothed pulley 90. The toothed pulley 90 is coupled to another toothed pulley (not shown) mounted on the drum shaft 20 by a toothed control belt 92. Also mounted on the drum shaft 20 is a large toothed pulley 94 (referred to herein as the "drum pulley").

An upper toothed pulley 96 is mounted on the upper tape reel shaft 24, via a one-way clutch 98 that prevents the upper toothed pulley 96 from rotating the upper tape reel shaft 24 in the deposit direction. The deposit direction for the upper tape reel shaft 24 is illustrated in FIG. 2 by arrow 100. This is because the one-way clutch 98 slips when the upper toothed pulley 96 is rotated in the deposit direction, but grips when the upper toothed pulley 96 is rotated in the dispense direction.

A lower toothed pulley 106 is mounted on the lower tape reel shaft 34, via a one-way clutch 108 that prevents the lower toothed pulley 106 from rotating the lower tape reel shaft 34 in the deposit direction, in the same way as the one-way clutch 98. The deposit direction for the lower tape reel shaft 34 is illustrated in FIG. 2 by arrow 110.

In this embodiment, the upper and lower toothed pulleys 96,106 are identical.

In this embodiment, the one-way clutches 98,108 comprise drawn cup roller clutches, specifically part number HF0812-R available from Schaeffler (UK) Ltd, Forge Lane, Minworth, Sutton Coldfield B76 1AP, UK, although any convenient one-way clutch may be used.

The deposit direction for the drum shaft 20 is illustrated in FIG. 2 by arrow 112. As will be clear from FIG. 2, the deposit direction is the same for each of the tape reel shafts 24,34 and the drum shaft 20.

An idler toothed pulley 116 is provided between the upper toothed pulley 96, the lower toothed pulley 106, and the drum pulley 94. The idler toothed pulley 116 is mounted on a stub shaft 118 for free rotation thereabout. The stub shaft 118 is mounted to an outer surface of one of the sidewalls 12 by a bracket 120 including a journal bearing (not shown).

A toothed endless belt 122 extends around the drum pulley 94, the upper toothed pulley 96, and the lower toothed pulley 106. The toothed endless belt 122 can be moved in the forward belt direction 124 or the reverse belt direction 126. The forward belt direction 124 corresponds to the dispense direction; whereas the reverse belt direction 126 corresponds to the deposit direction.

The ratio of the number of teeth on the drum pulley 94 to the number of teeth on each of the upper and lower toothed pulleys 96,106 is approximately five to one. This ensures that the linear speed of the upper and lower tape reels 26,36 in the dispense direction is faster than the linear speed of the rotatable drum 22.

When the motor shaft 88 is rotated (by the motor 14) in the deposit direction (shown by arrow 130), then the one-way clutches 98,108 allow the upper and lower toothed pulleys 96,106 to rotate freely about the upper and lower tape reel shafts 24,34 respectively. In contrast, when the motor shaft 88 is rotated (by the motor 14) in the dispense direction (shown by arrow 132), then the one-way clutches 98,108 lock the upper and lower toothed pulleys 96,106 to the upper and lower tape reel shafts 24,34 respectively, so that the upper and lower tape reel shafts 24,34 rotate as the motor shaft 88 rotates.

Figure 4:
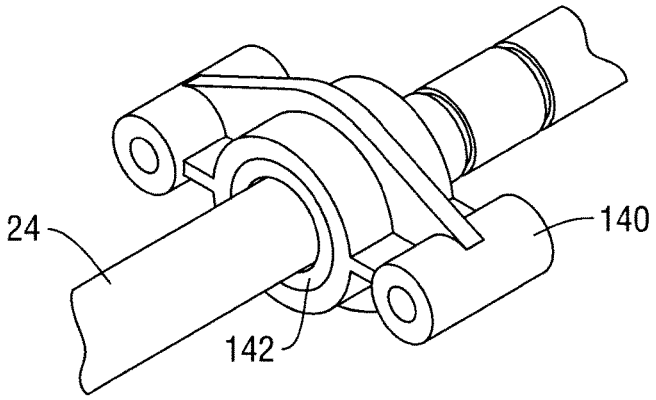
FIG. 4 is a diagram illustrating another part (a one-way clutch) of the media storage device of FIG. 1 in more detail.

Reference will now be made to FIG. 3, which is a diagram illustrating parts of the rotary storage device 10 in more detail. In particular, an upper shaft bracket 140 is shown mounted onto an inner surface of one of the sidewalls 12. The upper tape reel shaft 24 is mounted on a one-way clutch 142 within the upper shaft bracket 140. This is shown in more detail in FIG. 4.

A lower shaft bracket 150 is also shown mounted onto an inner surface of one of the sidewalls 12. The lower tape reel shaft 34 is mounted on a one-way clutch 152 within the lower shaft bracket 150.

In this embodiment, the one-way clutches 142,152 comprise drawn cup roller clutches, specifically part number HF0812-R available from Schaeffler (UK) Ltd, Forge Lane, Minworth, Sutton Coldfield B76 1AP, UK, although any other convenient one-way clutch could be used.

The one-way clutches 142,152 ensure that the respective tape reel shafts 24,34 cannot rotate in the deposit direction (shown by arrows 160 in FIG. 3).

Depositing Banknotes

To deposit banknotes into the rotatable drum 22, the motor 14 is energized and the motor shaft 88 is rotated in the deposit direction. This causes the toothed control belt 92 to drive the drum shaft 20, which turns the rotatable drum 22 in the deposit direction.

The toothed control belt 92 also rotates the drum pulley 94 in the deposit direction, which drives the toothed endless belt 122 in the reverse belt direction 126. However, the one-way clutches 98,108 cause the upper toothed pulley 96 and the lower toothed pulley 106 to slip around the upper and lower tape reel shafts 24,34, respectively, so that neither of these tape reel shafts 24,34 rotate due to the toothed endless belt 122 rotating in the deposit direction. Furthermore, the one-way clutches 142,152 ensure that the respective tape reel shafts 24,34 cannot rotate in the deposit direction even if (i) the one-way clutches 98,108 do not completely slip relative to the shafts 24,34, or (ii) vibrations in the rotary storage device 10 would otherwise cause the shafts 24,34 to turn in the deposit direction.

When the rotatable drum 22 is rotated in the deposit direction, the upper and lower tape 40,60 is further wound around the rotatable drum 22, causing the upper tape reel 26 and lower tape reel 36 to rotate about their respective tape reel shafts 24,34. This is because the resistive force provided by the first and second friction clutches 28,38 is less than the pulling force applied by the upper and lower tape 40,60.

Banknotes, or other media items, can then be fed into the media slot 86 for storing between the upper and lower tapes 40,60 around the rotatable drum 22.

Dispensing Banknotes

To dispense banknotes from the rotatable drum 22, the motor 14 is energized (in the reverse direction to the deposit direction) and the motor shaft 88 is rotated in the dispense direction. This causes the toothed control belt 92 to drive the drum shaft 20, which turns the rotatable drum 22 in the dispense direction.

The toothed control belt 92 also rotates the drum pulley 94 in the dispense direction, which drives the toothed endless belt 122 in the forward belt direction 124. The one-way clutches 98,108 cause the upper toothed pulley 96 and the lower toothed pulley 106 to lock onto the upper and lower tape reel shafts 24,34, respectively, so that both of these tape reel shafts 24,34 rotate.

The friction clutches 28,38 ensure that the tape reels 26,36 rotate with their respective tape reel shafts 24,34 in the dispense direction. In other words, the resistive force applied by the friction clutches 28,38 is greater than the rotational force applied by the tape reel shafts 24,34.

Banknotes, or other media items, can then be fed out from the rotatable drum 22 and through the media slot 86 for dispensing to a customer.

It should be appreciated that this rotary storage device 10 may be part of a recycler module (not shown) that may include various conventional components, such as a media thickness sensor, a media recognition unit, media transports, and the like.

The recycler module may be incorporated into a terminal, such as a self-service terminal (which may be an automated teller machine).

Various modifications may be made to the above described embodiment within the scope of the invention, for example, in other embodiments, a single tape rotary storage device may be used that only has one tape reel and one tape.

In other embodiments a friction brake other than a friction clutch may be used. A fixed (rather than an adjustable) friction clutch may be used.

In other embodiments, the composition and dimensions of the tape may be different than those described.

In other embodiments, the shaft rotation mechanism may be different to the belt and pulley arrangement described above.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

What is claimed is:

1. A rotary storage device comprising:

a rotatable drum around which media items may be stored;

an upper tape reel rotatably mounted on an upper tape reel shaft and partially wound with tape extending from the upper tape reel to the rotatable drum, the upper tape reel shaft mounted on an upper one-way clutch within an upper shaft bracket;

a lower tape reel rotatably mounted on a lower tape reel shaft and partially wound with tape extending from the lower tape reel to the rotatable drum, the lower tape reel shaft mounted on a lower one-way clutch within a lower shaft bracket;

a motor coupled to a motor shaft, and operable to rotate in a deposit direction and in a dispense direction opposite the deposit direction;

an upper friction clutch coupled to both the upper tape reel shaft and the upper tape reel to provide some resistance to rotation of the upper tape reel relative to the upper tape reel shaft so that the upper tape reel cannot rotate freely about the upper tape reel shaft;

a lower friction clutch coupled to both the lower tape reel shaft and the lower tape reel to provide some resistance to rotation of the lower tape reel relative to the lower tape reel shaft so that the lower tape reel cannot rotate freely about the lower tape reel shaft;

the upper one-way clutch coupled to the upper tape reel shaft by the upper shaft bracket to allow the upper tape reel shaft to rotate in the dispense direction and to prevent the upper tape reel shaft from rotating in the deposit direction;

the lower one-way clutch coupled to the lower tape reel shaft by the lower shaft bracket to allow the lower tape reel shaft to rotate in the dispense direction and to prevent the lower tape reel shaft from rotating in the deposit direction;

an upper pinch shaft having a pair of upper deformable rollers mounted thereon;

a lower pinch shaft having a pair of lower deformable rollers mounted thereon;

belt pulleys;

a drum shafted tooth pulley mounted on the drum shaft, wherein a circumference of the drum shaft toothed pulley is greater than circumferences of the belt pulleys by a ratio of 5 to 1, an idler toothed pulley mounted on a stub shaft for free rotation there about, wherein the idler toothed pulley is vertically situated below and horizontally offset from an upper toothed pulley and the idler toothed pulley is vertically situated above and horizontally offset from a lower toothed pulley, the upper toothed pulley mounted on the upper tape reel shaft and the lower toothed pulley mounted on the lower tape reel shaft, and wherein the motor is coupled to the motor shaft and a motor pulley is mounted on the motor shaft, the motor pulley coupled to a drum shaft via a toothed control belt, the drum shaft coupled to the rotatable drum, and the drum shaft toothed pulley coupled to the upper toothed pulley, the idler toothed pulley, and the lower toothed pulley via a toothed endless belt, and wherein a ratio of number of teeth on the drum shaft toothed pulley to other teeth on the upper and lower toothed pulleys is approximately five to one ensuring that a linear speed of the upper and lower tape reels is faster in the dispense direction than another linear speed of the rotatable drum, and wherein the upper and lower deformable rollers are mutually aligned in proximity to one another having a gap between the upper and lower deformable rollers, the gap is thinner than banknotes fed through the upper and lower deformable rollers ensuring the upper and lower deformable rollers are deformed by each banknote passing through the gap with the upper and lower deformable rollers maintaining contact with each banknote passing through the gap, and wherein the rotary storage device includes just one motor that is the motor, and the motor is configured to drive both the upper and lower tape reel shafts and rotatable drum.

2. A rotary storage device according to claim 1, wherein the upper and lower friction clutches are adapted to be adjustable so that the level of resistance to motion can be set.

3. A method of storing media items between layers of tape wound on a rotatable drum, the method comprising:

rotating the drum in a deposit direction to unwind tape from two tape reels and to wind the tape onto the drum using belts and pulleys interfaced to one another and the rotatable drum;

providing two friction brakes imparting resistive force to motion of the tape reels relative to two tape reel shafts, where the resistive forces are less than an amount of forces applied to the two tape reels in the deposit direction but greater than an amount of forces applied to the two tape reels in a dispense direction, which is opposite to the deposit direction;

using one-way clutches, each clutch coupled to one of the two tape reel shaft to prevent the two tape reel shafts from rotating in the deposit direction as the two tape reels rotate and ensuring that a linear speed of the two tape reels in the dispense direction is faster than another linear speed of the rotatable drum by activating a drum toothed pulley having a circumference greater than circumferences of belt pulleys by a ratio of five to one and the drum toothed pulley having a ratio of a number of teeth on a drum toothed pulley to other teeth on upper and lower toothed pulleys that is approximately five to one, wherein an upper tape reel shaft is mounted on an upper one-way clutch within an upper shaft bracket, and wherein a lower tape reel shaft is mounted on a lower one-way clutch within a lower shaft bracket;

maintaining contact by upper and lower deformable rollers in the deposit and dispense directions as banknotes pass through a gap between the upper and lower deformable rollers, wherein the gap is thinner than the banknotes; and using one motor to drive both the two tape reel shafts and the rotatable drum.

* * * * *